US010996588B1

(12) United States Patent
Kato et al.

(10) Patent No.: US 10,996,588 B1
(45) Date of Patent: May 4, 2021

(54) POWDER TRANSPORT APPARATUS

(71) Applicant: FUJI XEROX CO., LTD., Tokyo (JP)

(72) Inventors: Masanori Kato, Kanagawa (JP); Shinichi Kuramoto, Kanagawa (JP); Yoshifumi Ozaki, Kanagawa (JP); Tomoyuki Yoshii, Kanagawa (JP); Yoshitaka Nakajima, Kanagawa (JP); Norihiro Tamazawa, Kanagawa (JP); Shigemi Murata, Kanagawa (JP); Takashi Ochi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/897,369

(22) Filed: Jun. 10, 2020

(30) Foreign Application Priority Data

Dec. 11, 2019 (JP) ..... JP2019-224001

(51) Int. Cl.
*G03G 15/08* (2006.01)

(52) U.S. Cl.
CPC ..... *G03G 15/0877* (2013.01); *G03G 15/0865* (2013.01); *G03G 15/0891* (2013.01); *G03G 2215/0132* (2013.01); *G03G 2215/0802* (2013.01)

(58) Field of Classification Search
CPC ..... G03G 15/0877; G03G 15/0865; G03G 2215/0802; G03G 2215/0132
See application file for complete search history.

(56) References Cited

U.S. PATENT DOCUMENTS

| | | | | |
|---|---|---|---|---|
| 7,369,796 | B2 * | 5/2008 | Amano | G03G 15/0893 399/254 |
| 8,524,436 | B2 * | 9/2013 | Nagayama | G03G 15/0877 430/123.53 |
| 10,152,000 | B2 * | 12/2018 | Ariizumi | G03G 15/0893 |
| 10,409,194 | B2 * | 9/2019 | Okuno | G03G 15/0877 |
| 2007/0127951 | A1 * | 6/2007 | Ishikawa | G03G 15/0808 399/254 |
| 2011/0150537 | A1 * | 6/2011 | Watanabe | G03G 15/0844 399/256 |

FOREIGN PATENT DOCUMENTS

| | | |
|---|---|---|
| JP | 2008-256917 A | 10/2008 |
| JP | 2015-155943 A | 8/2015 |

* cited by examiner

*Primary Examiner* — Arlene Heredia
(74) *Attorney, Agent, or Firm* — Sughrue Mion, PLLC

(57) ABSTRACT

A powder transport apparatus includes a first transport path disposed in the first transport path, a second transport path connected to the first transport path through a first connection port and a junction port, a third transport path connected to the second transport path through a second connection port, a second transport member that is disposed in the second transport path and includes a first shaft provided with a first spiral blade that transports powder toward the first connection port, a second spiral blade that is provided in a portion of the first shaft between the first connection port and the junction port and that has a transport force smaller than a transport force of the first spiral blade in the one direction, and a third transport member disposed in the third transport path. The third transport member transports the powder toward the second connection port.

19 Claims, 5 Drawing Sheets

POWDER TRANSPORT APPARATUS

CROSS-REFERENCE TO RELATED APPLICATIONS

This application is based on and claims priority under 35 USC 119 from Japanese Patent Application No. 2019-224001 filed Dec. 11, 2019.

BACKGROUND

1. Technical Field

The present disclosure relates to a powder transport apparatus.

2. Related Art

JP-A-2008-256917 discloses a developing apparatus including a developer carrier that develops a latent image on a latent image carrier by carrying a developer including a magnetic carrier and a toner on a surface, plural developer transport paths each having a developer transport member that is disposed at substantially the same height parallel with each other and transports the developer in its own axial direction, a partition member that partitions the plural developer transport paths respectively, and an opening that communicates with another developer transport path adjacent to a downstream portion of the developer transport direction of each of the plural developer transport paths, in which the developer transport member in each of the plural developer transport paths feeds the developer to the adjacent another developer transport path rather than to the opening, so that the developer is circularly transported in the plural developer transport paths. In the developer apparatus, at least one of the plural developer transport member includes a screw portion provided with a spiral blade having a predetermined lead angle, a paddle portion provided with a blade parallel to the axial direction, a connecting portion provided with a blade that approaches to be parallel with the axial direction by increasing the lead angle stepwise or continuously to be larger than the lead angle of the screw portion, so as to connect the downstream end of the developer transport direction of the screw portion and the upstream end of the developer transport direction of the paddle portion. The connecting portion and the paddle portion are disposed to face the opening.

SUMMARY

Aspects of non-limiting embodiments of the present disclosure relate to preventing powder from being stayed in a junction port as compared with a configuration in which a transport force of a second spiral blade in one direction is equal to a transport force of a first spiral blade.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a powder transport apparatus including: a first transport path extending in one direction, a first transport member being disposed in the first transport path; a second transport path extending in the one direction, the second transport path being connected to the first transport path through a first connection port and a junction port positioned closer to an end side of the one direction than the first connection port; a third transport path extending in the one direction, the third transport path being connected to the second transport path through a second connection port positioned to be overlapped with the junction port in the one direction; a second transport member disposed in the second transport path, the second transport member including a first shaft that extends in the one direction, the first shaft being provided with a first spiral blade configured to transport powder toward the first connection port from a side opposite to the junction port side across the first connection port in the one direction; a second spiral blade provided in a portion of the first shaft between the first connection port and the junction port, the second spiral blade having a transport force smaller than a transport force of the first spiral blade in the one direction; and a third transport member disposed in the third transport path, the third transport member being configured to transport the powder toward the second connection port.

BRIEF DESCRIPTION OF THE DRAWINGS

Exemplary embodiment(s) of the present disclosure will be described in detail based on the following figures, wherein.

DETAILED DESCRIPTION

Hereinafter, an example of a powder transport apparatus, a developing apparatus, and an image forming apparatus according to an exemplary embodiment of the present disclosure will be described with reference to the accompanying drawings.

In the following description, in a front view of an image forming apparatus 10 from a side where a user (not illustrated) stands, an apparatus vertical direction (a vertical direction), an apparatus width direction (horizontal direction), and an apparatus depth direction (horizontal direction) are denoted as H direction, W direction, and D direction, respectively. Further, when it is necessary to distinguish one side and the other side of each of the apparatus vertical direction, the apparatus width direction, and the apparatus depth direction, when viewing the image forming apparatus 10 from the front, an upper side is denoted as +H side, a lower side is denoted as −H side, a right side is denoted as +W side, a left side is denoted as −W side, a back side is denoted as −D side, and a front side is denoted as +D side.

(Image Forming Apparatus 10)

Figure 1:
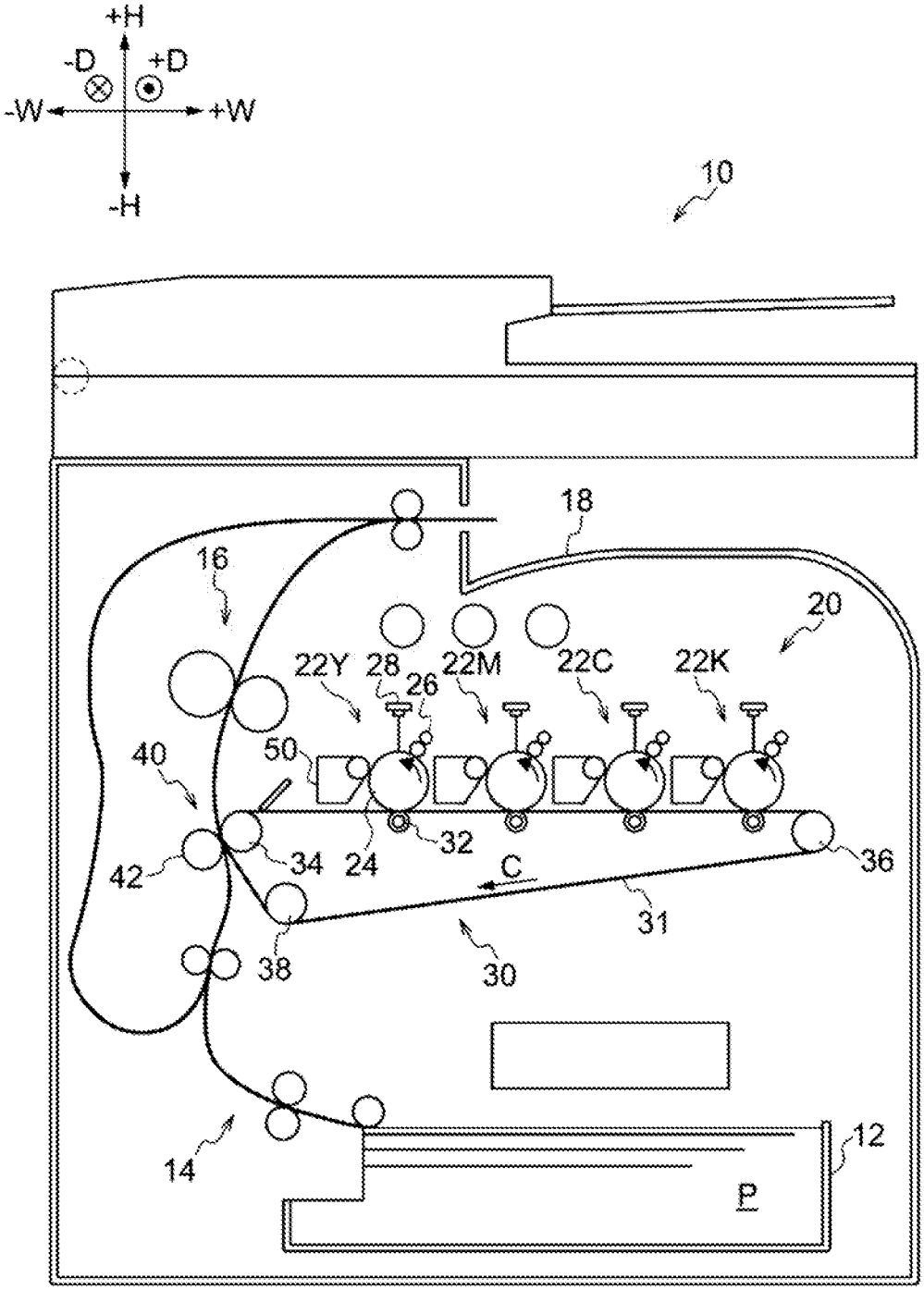
FIG. 1 is a schematic front view illustrating an image forming apparatus according to an exemplary embodiment.

The image forming apparatus 10 according to an exemplary embodiment is a color image forming apparatus that forms a color image and fixes it on a sheet member P that is an example of a recording medium. As illustrated in FIG. 1, the image forming apparatus 10 includes an accommodating unit 12, a discharge unit 18, a transport unit 14, an image forming unit 20, and a fixing unit 16. The image forming apparatus according to the exemplary embodiment of the disclosure is not limited to a color image forming apparatus. For example, the image forming apparatus according to the exemplary embodiment of the disclosure may be a mono color image forming apparatus that forms a monochrome toner image and fixes it on the sheet member P.

The accommodating unit 12 has a function of accommodating the sheet member P.

The discharge unit 18 is configured to discharge the sheet member P on which an image formed by the image forming unit 20 is fixed by the fixing unit 16.

The transport unit 14 has a function of transporting the sheet member P accommodated in the accommodating unit 12 to a transfer position T at which an image is formed by transfer. Further, the transport unit 14 has a function of transporting the sheet member P on which an image is fixed by the fixing unit 16 to the discharge unit 18 and discharging it.

The image forming unit 20 has a function of forming an image on the sheet member P in an electrophotographic manner. Specifically, the image forming unit 20 includes four image forming units 22Y, 22M, 22C, and 22K, a transfer unit 30, and plural toner cartridges (not illustrated). Here, yellow (Y), magenta (M), cyan (C), and black (K) are examples of toner colors. The image forming units 22Y, 22M, 22C, and 22K include a photoconductor drum 24, a charging roller 26, an exposure device 28, and a developing apparatus 50, respectively. The image forming units 22Y, 22M, 22C, and 22K form a toner image of each color of yellow (Y), magenta (M), cyan (C), and black (K) on an outer peripheral surface of each photoconductor drum 24.

The photoconductor drum 24 is an example of an image carrier that holds a latent image. The charging roller 26 is an example of a charging device that charges the photoconductor drum 24. The exposure device 28 exposes the photoconductor drum 24 charged by the charging roller 26 to form an electrostatic latent image as an example of a latent image on the photoconductor drum 24. The developing apparatus S develops the electrostatic latent image formed on the photoconductor drum 24 by the exposure device 28 by using a developer G including a toner accommodated therein as a toner image. Details of the developing apparatus 50 will be described later.

The transfer unit 30 includes a transfer belt 31, plural primary transfer rollers 32, a backup roller 34, a driving roller 36, a support roller 38, and a secondary transfer unit 40. The number of the primary transfer rollers 32 corresponds to the number of the toner colors, and four primary transfer rollers 32 are provided in the exemplary embodiment. The four primary transfer rollers 32 face each photoconductor drum 24 of the image forming units 22Y, 22M, 22C, and 22K, respectively. The transfer belt 31 is an endless belt that is supported by the primary transfer rollers 32, the backup roller 34, the driving roller 36, and the support roller 38 at its inner peripheral surface. Further, the transfer belt 31 is in contact with each photoconductor drum 24 of the image forming units 22Y, 22M, 22C, and 22K at its outer peripheral surface. That is, the transfer belt 31 is sandwiched by each of the four primary transfer rollers 32 and the photoconductor drums 24. The driving roller 36 is connected with a motor (not illustrated), and, in the exemplary embodiment, rotates the transfer belt 31 in a direction of arrow C illustrated in FIG. 1 by being rotated clockwise as viewed from the front. At this time, each of the photoconductor drums 24 is rotated counterclockwise as viewed from the front, so that the toner image developed on each of the photoconductor drums 24 is primarily transferred to the outer peripheral surface of the transfer belt 31.

The secondary transfer unit 40 includes a secondary transfer roller 42. The secondary transfer roller 42 faces the backup roller 34 across the transfer belt 31. A space between the secondary transfer roller 42 and the transfer belt 31 is a secondary transfer region N that is an example of a transfer position T. The secondary transfer roller 42 rotates while interposing the sheet member P transported to the secondary transfer region N by the transport unit 14 and the transfer belt 31 in the secondary transfer region N across the backup roller 34. As a result, the toner image primarily transferred to the outer peripheral surface of the transfer belt 31 is secondarily transferred to the sheet member P. The secondary transfer roller 42 transports the sheet member P to which the toner image is secondarily transferred to the fixing unit 16. At this time, in the exemplary embodiment, as illustrated in FIG. 1, the secondary transfer roller 42 rotates counterclockwise as viewed from the front. The secondary transfer roller 42 transfers the toner image formed on the photoconductor drum 24 to the sheet member P via the primary transfer. The secondary transfer roller 42 is an example of a transfer unit.

In the exemplary embodiment, the fixing unit 16 is configured as a fixing device that fixes the toner image transferred to the sheet member P by the secondary transfer roller 42 to the sheet member P by heating and pressing the sheet member P.

The plural toner cartridges (not illustrate) correspond to each of the colors formed by the image forming unit 20, and accommodate the developer G made from a toner and a magnetic carrier of each color. That is, in the exemplary embodiment, the image forming unit 20 includes four toner cartridges of yellow (Y), magenta (M), cyan (C), and black (K). The four toner cartridges are connected to a third transport path 60*c* (to be described later in detail) of the developing apparatus 50 corresponding to each color, through a supply path (not illustrated). When the toner is consumed in the developing apparatus 50 by the developing of each developing apparatus 50, the four toner cartridges replenish new developer G to the third transport path 60*c* of each developing apparatus 50. The developer G is an example of powder.

(Developing Apparatus 50)

Subsequently, the developing apparatus 50 will be described. Since the developing apparatus 50 of the image forming units 22Y, 22M, 22C, and 22K has the same structure, one developing apparatus 50 will be described in the following.

Figure 2:
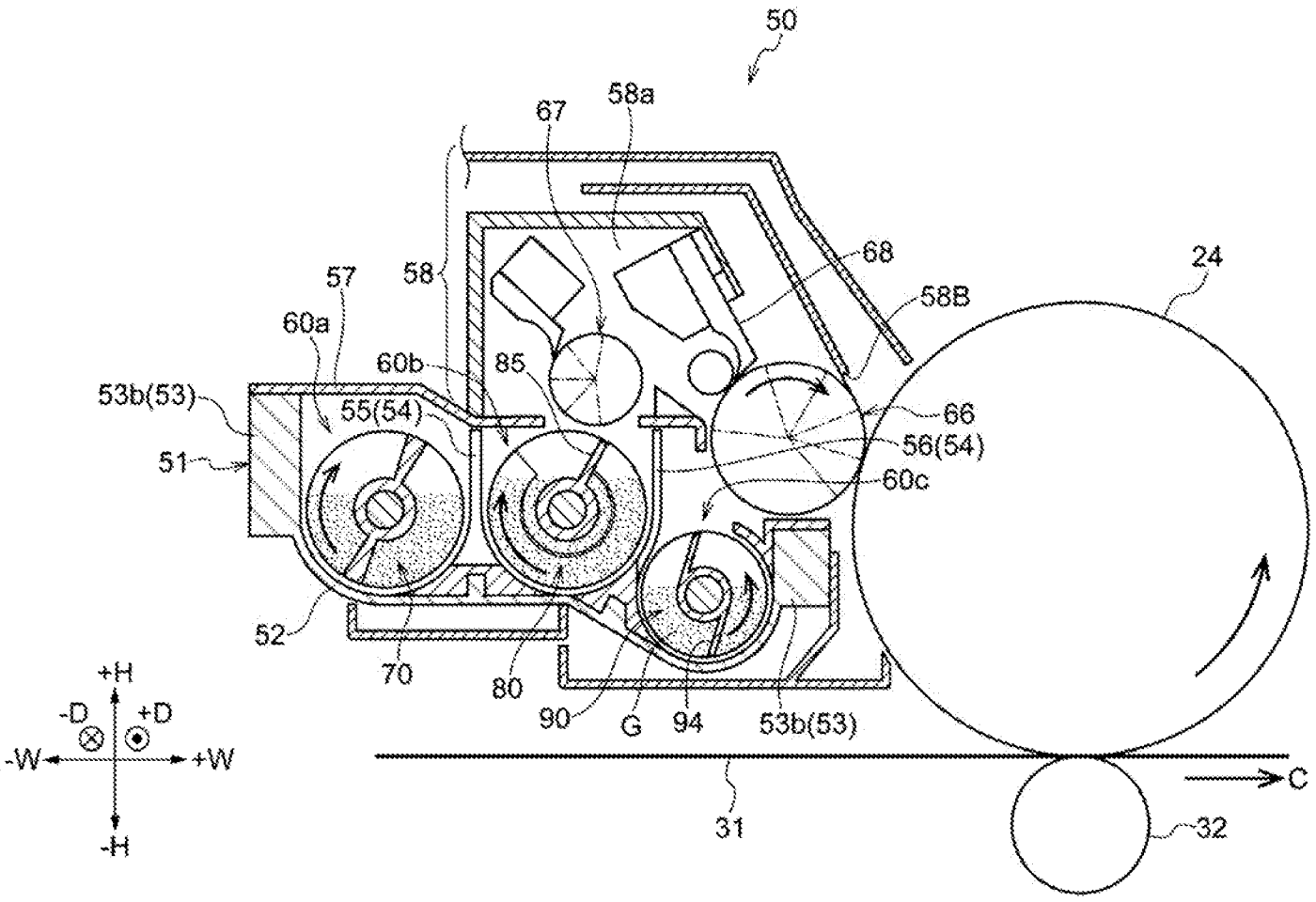
FIG. 2 is a front cross-sectional view of a developing apparatus according to the exemplary embodiment.
Figure 3:
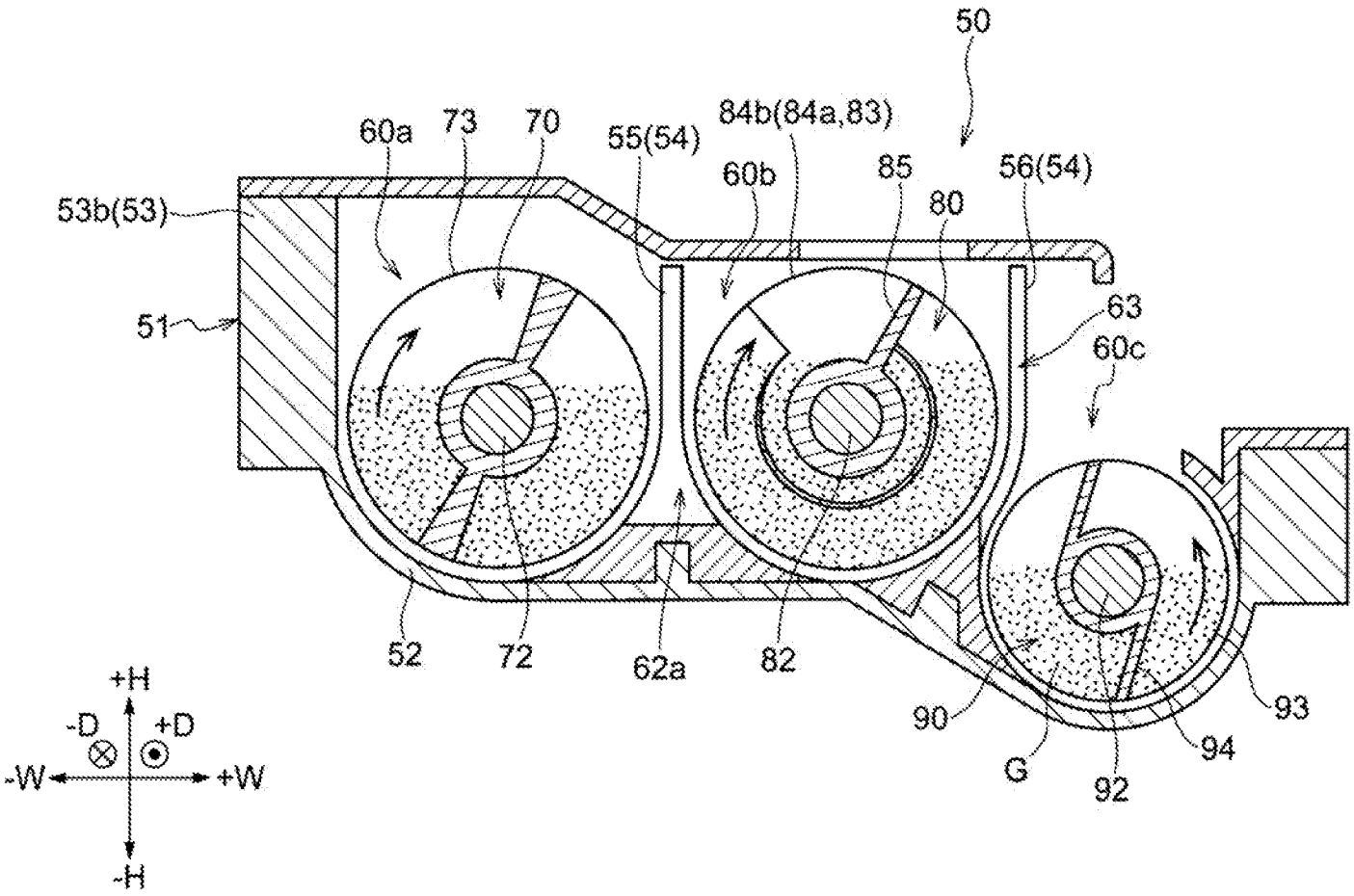
FIG. 3 is an enlarged front cross-sectional view illustrating a part of FIG. 2.
Figure 4:
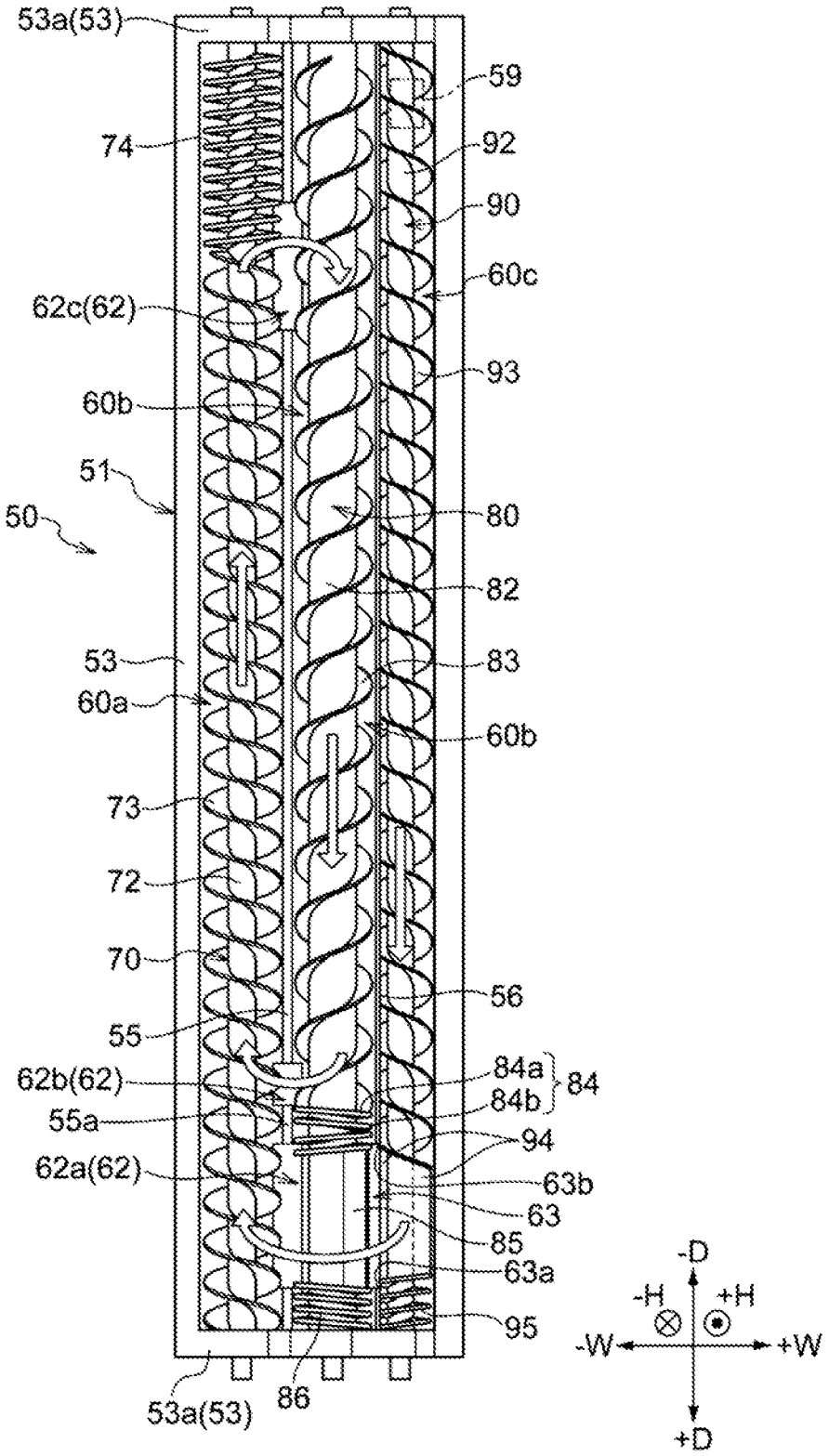
FIG. 4 is a plan cross-sectional view of the developing apparatus according to the exemplary embodiment.

As illustrated in FIGS. 2 and 4, the developing apparatus 50 extends in the apparatus depth direction, and includes a housing 51, a developing roller 66, pumping roller 67, a layer regulating member 68, a first transport member 70, a second transport member 80, and a third transport member 90. In the exemplary embodiment, the developing apparatus 50 is disposed on −W side of the photoconductor drum 24. The developing apparatus 50 accommodates the developer G therein. A combination of the housing 51, the first transport member 70, the second transport member 80, and the third transport member 90 is an example of the powder transport apparatus (see FIG. 3).

As illustrated in FIGS. 2 and 4, the housing 51 includes a bottom wall 52 extending in the apparatus depth direction in a plan view, and a peripheral wall 53 risen from the periphery of the bottom wall to +H side. Further, the housing 51 includes two partition walls risen from the bottom wall 52 to +H side and extending in the apparatus depth direction, and disposed side by side in the apparatus width direction. The space defined by the bottom wall 52 and the peripheral wall 53 of the housing 51 is divided into three transport paths 60 parallel with each other in the apparatus width direction by the two partition walls 55 and 56. In the exemplary embodiment, the partition wall of −W side is referred to as the partition wall 55, and the partition wall of +W side is referred to as the partition wall 56. As illustrated in FIGS. 2 and 3, in the transport path 60 according to the exemplary embodiment, in the apparatus width direction, the space divided by the peripheral wall 53 and the partition wall 55 becomes a first transport path 60*a*, and the space divided by the partition wall 55 and the partition wall 56 becomes a second transport path 60*b*. Further, in the apparatus width direction, the space divided by the partition wall 56 and the peripheral wall 53 becomes a third transport path 60*c*. The first transport path 60*a*, the second transport path 60*b*, and the third transport path 60*c* accommodate the developer G respectively. The third transport path 60*c* is connected to a toner cartridge (not illustrated) through a supply port 59 formed at an end portion of −D side and a supply path (not illustrated). End walls 53*a* of the peripheral wall 53 on both sides in the apparatus depth direction are configured as a bearing portion that freely rotatably supports the first transport member 70, the second transport member 8), and the third transport member 90 (each to be described later in detail) provided in the three transport paths 60, respectively. The first transport path 60*a* overlaps the second transport path 60*b* in the apparatus width direction. That is, the bottom portion of the first transport path 60*a* coincides with the bottom portion of the second transport path 60*b* in the apparatus vertical direction. Meanwhile, the bottom portion of the third transport path 60*c* is positioned on −H side of the second transport path 60*b*. That is, the bottom portion of the second transport path 60*b* is positioned above the bottom portion of the third transport path 60*c* in the gravity direction. Specifically, the positional relationship in the apparatus vertical direction between the second transport path 60*b* and the third transport path 60*c* is in a range where a portion of the second transport member 80 on −H side of a first shaft 82 and a portion of the third transport member 90 on +H side of a second shaft 92 are overlapped with each other.

Further, as illustrated in FIG. 2, the housing 51 includes a cover portion 57 that seals above the first transport path 60*a*, and an overhang portion 58 that covers above the second transport path 60*b* and the third transport path 60*c*, as viewed from the front. In the space between the overhang portion 58 and the second transport path 60*b* and the third transport path 60*c*, a roller chamber 58*a* in which the pumping roller 67, the layer regulating member 68, and the developing roller 66 (to be described later) are disposed is formed. The roller chamber 58*a* includes an opening 58*b* that causes the developing roller 66 to face the photoconductor drum 24.

As illustrated in FIG. 4, the partition wall 55 has connection ports 62 that are three openings separated from each other in the apparatus depth direction. The three connection ports 62 connect the first transport path 60*a* and the second transport path 60*b*, respectively. In the exemplary embodiment, the respective three connection ports 62 are configured as a junction port 62*a* and connection ports 62*b* and 62*c*, in order from +D side in the apparatus depth direction. A portion of the partition wall 55 sandwiched between the junction port 62*a* and the connection port 62*b* is configured as an intermediate wall 55*a*. In other words, the junction port 62*a* and the connection port 62*b* are divided by the intermediate wall 55*a* as a boundary. In the apparatus depth direction, the length of the opening width of the junction port 62*a* is larger than the length of the opening width of the connection port 62*b*. The connection port 62*b* is an example of a first connection port. In the exemplary embodiment, the intermediate wall 55*a* (the partition wall 55) may not exist between the junction port 62*a* and the connection port 62*b*, and the junction port 62*a* and the connection port 62*b* may be connected with each other in the apparatus depth direction, so as to form one opening. In this case, the position of the boundary between the junction port 62*a* and the connection port 62*b* coincides with the position of an edge 63*b* of a connection port 63 (to be described later) on the connection port 62*c* side (−D side) with respect to the junction port 62*a*. That is, in the one opening formed by connecting the junction port 62*a* and the connection port 62*b*, in the apparatus depth direction, a portion of the connection port 63 on −D side of the edge 63*b* becomes the connection port 62*b*, and a portion of the connection port 63 on +D side of the edge 63*b* becomes the junction port 62*a*. In this case, in order to easily transport the developer G transported from −D side of the second transport path 60*b* via the connection port 62*b*, a second spiral blade 84 may include at least a reverse transport blade 84*a*.

The partition wall 56 has the connection port 63 positioned to be overlapped with the junction port 62*a* in the apparatus depth direction. The connection port 63 connects the second transport path 60*b* and the third transport path 60*c*. Further, the third transport path 60*c* is connected to the first transport path 60*a* through the connection port 63, the portion of the second transport path 60*b* where the second transport path 60*b* faces the junction port 62*a*, and the junction port 62*a*. The connection port 63 is an example of a second connection port. An edge 63*a* of the connection port 63 on a side (+D side) opposite to the connection port 62*c* with respect to the junction port 62*a* may be positioned, in the apparatus depth direction, within a range of +3 mm with respect to the edge of the junction port 62*a* on a side (+D side) opposite to the connection port 62*c* side. The edge 63*a* of the connection port 63 may be positioned, in the apparatus depth direction, within a range of +2 mm with respect to the edge of the junction port 62*a* on +D side. In the exemplary embodiment, the edge 63*a* of the connection port 63 is positioned, in the apparatus depth direction, within a range of +1 mm with respect to the edge of the junction port 62*a* on +D side. Further, in the exemplary embodiment in which the intermediate wall 55*a* is exist, the edge 63*b* of the connection port 63 in a side (−D side) opposite to the edge 63*a* may be positioned, in the apparatus depth direction, within a range of the intermediate wall 55*a* or within a range of 3 mm from the edge of the intermediate wall 55*a* on the junction port 62*a* side (+D side) to +D side. The edge 63*b* of the connection port 63 may be positioned, in the apparatus depth direction, within a range of 2 mm from the edge of the intermediate wall 55*a* on +D side to −D side. In the exemplary embodiment, the edge 63*b* of the connection port 63 is positioned, in the apparatus depth direction, within a range of 1 mm from the edge of the intermediate wall 55*a* on +D side.

As illustrated in FIG. 2, the pumping roller 67 is a roller-shaped member disposed in the roller chamber 58*a* above the second transport path 60*b*. The pumping roller 67 is accommodated in the second transport path 60*b*, and pumps the developer G including the magnetic carrier to the roller chamber 58*a* by a magnetic force.

As illustrated in FIG. 2, the developing roller 66 is a roller-shaped member disposed in the roller chamber 58*a* above the third transport path 60*c* facing the photoconductor drum 24 across the opening 58*b*. The developing roller 66 forms a layer of the developer G on the surface by holding the developer G pumped from the second transport path 60*b* by the pumping roller 67 by a magnetic force, and supplies the developer G to the photoconductor drum 24 by being rotated in this state. The toner included in the developer G supplied to the photoconductor drum 24 by the developing roller 66 is attached to the electrostatic latent image on the photoconductor drum 24, so that the developing apparatus 50 develops the electrostatic latent image as a toner image.

As illustrated in FIG. 2, the layer regulating member 68 is disposed between the pumping roller 67 and the developing roller 66 in the apparatus width direction. The layer regulating member 68 regulates the layer of the developer G held by the developing roller 66 and transported to the position facing the photoconductor drum 24 to a predetermined thickness.

(First Transport Member 70)

As illustrated in FIG. 4, the first transport member 70 includes a shaft 72, a forward transport blade 73, and a reverse transport blade 74, and is disposed in the first transport path 60*a*. The shaft 72 extends in the apparatus depth direction, and is freely rotatably supported at the end wall 53*a* of the first transport path 60*a*. The forward transport blade 73 is a double-banded spiral blade body provided over the shaft 72 from the end portion of the shaft 72 in the first transport path 60*a* on the connection port 62*a* side with respect to the connection port 62*b* to a part facing the connection port 62*c*, and extending in the apparatus depth direction. In the exemplary embodiment, when the shaft 72 rotates clockwise as viewed from the front, the forward transport blade 73 agitates the developer G around the forward transport blade 73 while transporting from the junction port 62*a* toward the connection port 62*c* (−D side). The reverse transport blade 74 is a single-banded spiral blade body provided around the shaft 72 on −D side of the forward transport blade 73 and extending in the apparatus depth direction. In the exemplary embodiment, when the shaft 72 rotates clockwise as viewed from the front, the reverse transport blade 74 applies a braking force toward the connection port 62*c* (+D side) from the end portion on −D side of the shaft 72 to the developer G around the reverse transport blade 74. As a result, the reverse transport blade 74 prevents the developer G from entering into the reverse transport blade 74 side.

(Second Transport Member 80)

As illustrated in FIG. 4, the second transport member 80 includes a first shaft 82, a first spiral blade 83, a second spiral blade 84, a first paddle 85, and a third spiral blade 86, and is disposed in the second transport path 60*b*. The first shaft 82 extends in the apparatus depth direction, and is freely rotatably supported at the end wall 53*a* of the second transport path 60*b*. A portion of the first shaft 82 on −D side with respect to the junction port 62*a* has a larger diameter than that of the shaft 72 of the first transport member 70. As a result, the second transport member 80 is grasped as a member that makes the developer G easy to be supplied to the pumping roller 67 above the second transport member 80 by making the space of the second transport path 60*b* capable of accommodating the developer G to be narrower than the first transport path 60*a* so as to raise the developer G. The first shaft 82 is configured such that the outer diameter of the portion on +D side with respect to the junction port 62*a* is equal to the outer diameter of the portion on −D side with respect to the junction port 62*a*. Then, the portion of the first shaft 82 where the first shaft 82 faces the junction port 62*a* has a smaller diameter than the portion on −D side with respect to the junction port 62*a*, in the apparatus depth direction. In other words, the portion of the first shaft 82 where the first shaft 82 faces the connection port 63 in the apparatus depth direction has a smaller diameter than the portion on −D side with respect to the connection port 63. Specifically, the outer diameter of the portion of the first shaft 82 where the first shaft 82 faces the junction port 62*a* is 40% to 60% of the outer diameter of the portion on −D side with respect to the junction port 62*a*. In the exemplary embodiment of the disclosure, the expression "the outer diameter is equal" indicates that the outer diameter of one member is within a range of +3% of the outer diameter of the other member.

The first spiral blade 83 is a double-banded spiral blade body provided over the first shaft 82 from the end portion of the first shaft 82 in the second transport path 60*b* on the connection port 62*c* side with respect to the connection port 62*b* to a portion of the first shaft 82 where the first shaft 82 faces the connection port 62*b*. The double-banded spiral blade body extends in the apparatus depth direction. In the exemplary embodiment, when the first shaft 82 rotates clockwise as viewed from the front, the first spiral blade 83 supplies the developer G around the first spiral blade 83 to the pumping roller 67 and the developing roller 66 while transporting from the connection port 62*c* to the connection port 62*b* (+D side). That is, the first spiral blade 83 transports the developer G in the apparatus depth direction, from the side opposite to the junction port 62*a* to the connection port 62*b* (+D side) across the connection port 62*b*. A member other than the first spiral blade 83 such as a paddle is not provided in the portion of the first shaft 82 where the first shaft 82 faces the connection port 62*b*. That is, no other members, but the first spiral blade 83 is provided in the portion of the first shaft 82 where the shaft 82 faces the connection port 62*b*.

(Second Spiral Blade 84)

The second spiral blade 84 is provided in a portion of the first shaft 82 where the first shaft 82 faces the intermediate wall 55*a* in the apparatus depth direction. The second spiral blade 84 includes the reverse transport blade 84*a* and a forward transport blade 84*b*. That is, the second spiral blade 84 is provided in the portion of the first shaft 82 between the connection port 62*b* and the junction port 62*a*. Each of the reverse transport blade 84*a* and the forward transport blade 84*b* is a single-banded spiral blade body, and is disposed side by side in the order of the reverse transport blade 84*a* and the forward transport blade 84*b* from the first spiral blade 83 side in the apparatus depth direction. In other words, the forward transport blade 84*b* is provided on the side opposite to the first spiral blade 83 with respect to the reverse transport blade 84*a*. In the exemplary embodiment, the transport force of the second spiral blade 84 in the direction from the connection port 62*b* toward the junction port 62*a* side (+D side) is smaller than the transport force of the first spiral blade 83 in the direction toward +D side. In the exemplary embodiment of the disclosure, the expression "the transport force in the direction toward +D side" indicates that a transport amount [g/rotation] of the developer G in the direction toward +D side per one rotation of the transport member, and per one pitch of the spiral blade. "Smaller transport force" includes a case where the absolute value of the transport amount is small when the transport direction is the same as the compared target, and a case where the transport direction is opposite to the compared target (regardless of the absolute value of the transport amount).

Figure 5:
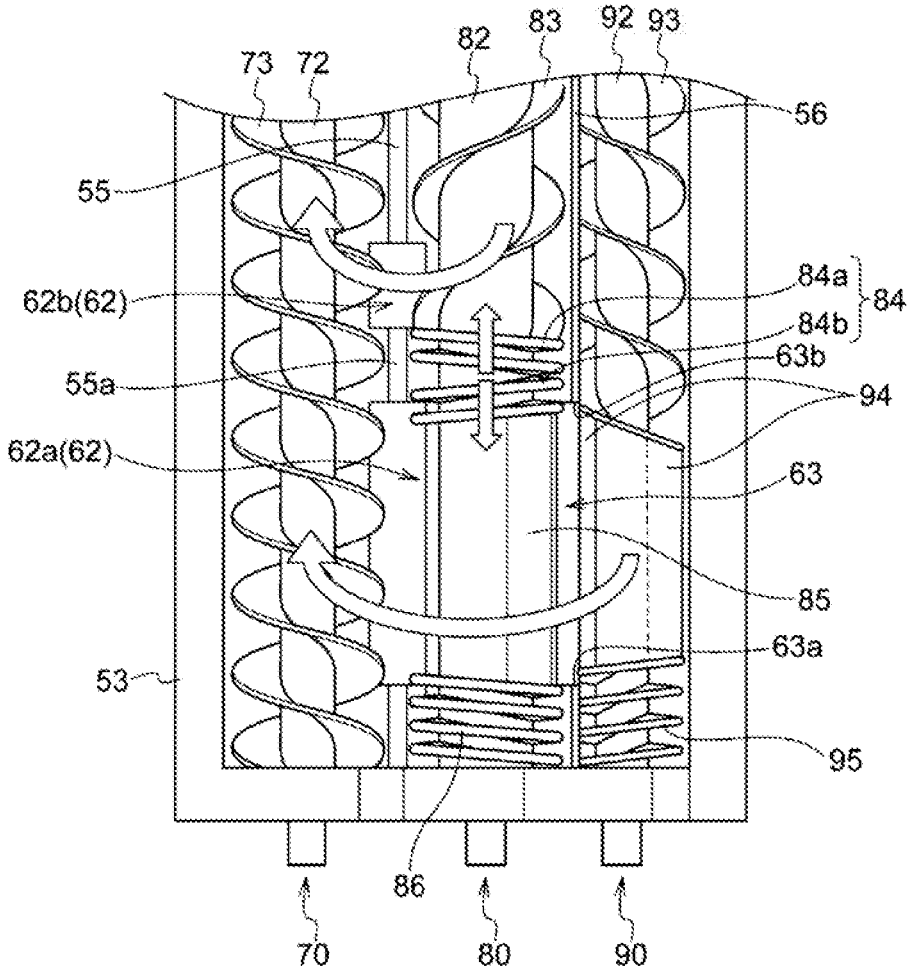
FIG. 5 is an enlarged plan cross-sectional view illustrating a part of FIG. 4.
Figure 5:
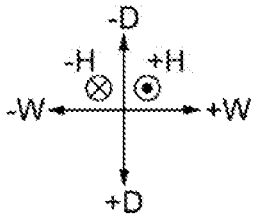

In the exemplary embodiment, when the first shaft 82 rotates clockwise as viewed from the front, as illustrated in FIG. 5, as a whole, the reverse transport blade 84*a* transports the developer G from the junction port 62*a* side toward the connection port 62*b* side (−D side), that is, in the direction opposite to the transport direction of the first spiral blade 83. Therefore, the transport force of the reverse transport blade 84*a* is smaller than the first spiral blade 83 in the direction toward +D side, and applies a braking force in the direction from the junction port 62*a* toward the connection port 62*b* (−D side) to the developer G transported to +D side by the first spiral blade 83. The reverse transport blade 84*a* is an example of a reverse transport unit. In the exemplary embodiment, the blade diameter of the reverse transport blade 84*a* is equal to the blade diameter of the first spiral blade 83, and the pitch thereof is smaller than the pitch of the first spiral blade 83. As a result, the absolute value of the transport force of the reverse transport blade 84*a* is smaller than the absolute value of the transport force of the first spiral blade 83. In the exemplary embodiment of the disclosure, the expression "the blade diameter is equal" indicates that the blade diameter of one member is within a range of ±3% of the blade diameter of the other member.

In the exemplary embodiment, when the first shaft 82 rotates clockwise as viewed from the front, as a whole, the forward transport blade 84*b* transports the developer G from the connection port 62*b* side toward the junction port 62*a* side (+D side), that is, in the same direction as the transport direction of the first spiral blade 83. The forward transport blade 84*b* is an example of a forward transport unit. In the exemplary embodiment, the blade diameter of the forward transport blade 84*b* is equal to the blade diameter of the first spiral blade 83, and the pitch thereof is smaller than the pitch of the first spiral blade 83. Therefore, the transport force of the forward transport blade 84*b* is smaller than that of the first spiral blade 83 in the direction of +D side, and may apply a braking force to the developer G transported to +D side by the first spiral blade 83. Further, the forward transport blade 84*b* applies a braking force in the direction from the connection port 63 toward the side (+D side) opposite to the connection port 62*b* side to the developer G on the side opposite to the reverse transport blade 84*a* side with respect to the forward transport blade 84*b*.

(First Paddle 85)

As illustrated in FIGS. 2 and 4, the first paddle 85 is a single plate-shaped member provided in the portion of the first shaft 82 where the first shaft 82 faces the junction port 62*a* in the apparatus depth direction and protruding and standing in the radial direction of the first shaft 82. In the exemplary embodiment, when the first shaft 82 rotates clockwise as viewed from the front, the first paddle 85 scoops up the developer G downstream side of the first paddle 85 in the rotation direction of the first shaft 82. The developer G scooped up by the first paddle 85 is transported to the first transport path 60*a* via the junction port 62*a*. Both end portions of the first paddle 85 in the apparatus depth direction may be positioned within a range of 3 mm toward the inside of the junction port 62*a* with respect to the both end portions of the junction port 62*a*. The both end portions of the first paddle 85 in the apparatus depth direction may be positioned within a range of 2 mm toward the inside of the junction port 62*a* with respect to the both end portions of the junction port 62*a*. In the exemplary embodiment, the both end portions of the first paddle 85 in the apparatus depth direction are positioned within a range of 1 mm toward the inside of the junction port 62*a* with respect to the both end portions of the junction port 62*a*.

The third spiral blade 86 is a single-banded spiral blade body provided in the first shaft 82 on the side opposite to the first spiral blade 83 with respect to the first paddle 85, and extending in the apparatus depth direction. In the exemplary embodiment, when the first shaft 82 rotates clockwise as viewed from the front, the third spiral blade 86 applies a braking force in the direction from the connection port 63 toward the side (−D side) opposite to the third spiral blade 86 side to the developer G around the third spiral blade 86. As a result, the third spiral blade 86 prevents the developer G from entering into the third spiral blade 86 side.

(Third Transport Member 90)

As illustrated in FIG. 4, the third transport member 90 includes a second shaft 92, a forward transport blade 93, a second paddle 94, and a reverse transport blade 95, and is disposed in the third transport path 60*c*. The second shaft 92 extends in the apparatus depth direction, and is freely rotatably supported at the end wall 53*a* of the third transport path 60*c*.

The forward transport blade 93 is a double-banded spiral blade body provided in the second shaft 92 in the third transport path 60*c* on the supply port 59 side with respect to the connection port 63, and extending in the apparatus depth direction. In the exemplary embodiment, when the second shaft 92 rotates counterclockwise as viewed from the front, the forward transport blade 93 agitates the developer G around the forward transport blade 93 while transporting from the supply port 59 side in the third transport path 60*c* toward the connection port 63 side (+D side).

(Second Paddle 94)

As illustrated in FIGS. 2 and 4, the second paddle 94 has two plate-shaped members provided in the portion of the second shaft 92 where the second shaft 92 faces the connection port 63 in the apparatus depth direction. In the exemplary embodiment, as illustrated in FIGS. 2 and 3, the second paddle 94 stands along a tangent to the outer periphery of the second shaft 92, and in a direction (tangential direction) protruding toward the downstream side in the rotation direction of the second shaft 92. Further, the phase difference between the two plate-shaped members of the second paddle 94 in the tangential direction is 180°. In the exemplary embodiment, when the second shaft 92 rotates counterclockwise as viewed from the front, the second paddle 94 scoops up the developer G downstream side of the second paddle 94 in the rotation direction of the second shaft 92. Then, the second paddle 94 that scoops up the developer G transports the developer G to the second transport path 60*b* via the connection port 63 by the rotation of the second shaft 92 so as to be thrown out from the upper side of the second shaft 92. That is, the second paddle 94 transports the developer G from the upper side of the second shaft 92 to the connection port 63 side with rotation of the second shaft 92. Both end portions of the second paddle 94 in the apparatus depth direction may be positioned within a range of 3 mm toward the inside of the connection port 63 with respect to the both end portions of the connection port 63. The both end portions of the second paddle 94 in the apparatus depth direction may be positioned within a range of 2 mm toward the inside of the connection port 63 with respect to the both end portions of the connection port 63. In the exemplary embodiment, the both end portions of the second paddle 94 in the apparatus depth direction are positioned within a range of 1 mm toward the inside of the connection port 63 with respect to the both end portions of the connection port 63.

The reverse transport blade 95 is a single-banded spiral blade body provided in the portion of the second shaft 92 on the side opposite to the forward transport blade 93 with respect to the second paddle 94, and extending in the apparatus depth direction. In the exemplary embodiment, when the second shaft 92 rotates counterclockwise as viewed from the front, the reverse transport blade 95 applies a braking force in the direction from the connection port 63 toward the side (−D side) opposite to the reverse transport blade 95 to the developer G around the reverse transport blade 95. As a result, the reverse transport blade 95 prevents the developer G from entering into the reverse transport blade 95 side.

The first transport member 70, the second transport member 80, and the third transport member 90 are connected to a driving device (not illustrated) having a motor and a gear train, and are driven to be rotated in the order of clockwise, clockwise, and counterclockwise, respectively. By the above driving, the developer G flows from the second transport path 60*b* toward the first transport path (0 via the connection port 62*b*, and then, the developer G flows from the first transport path 60*a* toward the second transport path 60*b* via the connection port 62*c* (see FIG. 4). As a result, in the developing apparatus 50, a circulation path for the developer G constituted by the first transport path 60*a*, the connection port 62*c*, the second transport path 60*b*, and the connection port 62*b* is formed, and the developer G accommodated in the second transport path 60*b* in the circulation path is supplied to the pumping roller 67 and the developing roller 66. When the developer G is supplied from the second transport path 60*b* to the pumping roller 67 and the developing roller 66 and consumed in the development, new developer G is replenished to the third transport path 60*c* from a toner cartridge (not illustrated) via the supply port 59. The new developer G replenished to the third transport path 60*c* is transported from the supply port 59 to the connection port 63 by the driving of the third transport member 90, and transported to the circulation path via the connection port 63, the portion of the second transport path 60*b* where the second transport path 60*b* faces the junction port 62*a*, and the junction port 62*a*.

[Operation and Effect]

Subsequently, operations and effect of the exemplary embodiment of the disclosure will be described. In the description, when describing a comparative embodiment with respect to the exemplary embodiment, in a case where the same components of the image forming apparatus 10 of the exemplary embodiment are used, the reference numerals and names of the components as they are will be used in the description.

The developing apparatus 50 of the exemplary embodiment has a configuration in which, in the +D side direction, the transport force of the second spiral blade 84 is smaller than the transport force of the first spiral blade 83 (first configuration). The developing apparatus 50 having the first configuration will be compared with a developing apparatus as a first comparative embodiment described in the following.

In the developing apparatus of the first comparative embodiment, the second spiral blade of the second transport member 80 has the same shape as the first spiral blade 83. As a result, in the second transport member 80 of the developing apparatus of the first comparative embodiment, the transport force of the second spiral blade in the +D side direction is equal to the transport force of the first spiral blade 83. Except for the above aspects, the first comparative embodiment has the same configuration as the exemplary embodiment.

In the developing apparatus having the junction port 62*a*, the connection port 62*b*, and the connection port 63, the developer G around the connection port 62*b* in the second transport path 60*b* has inertia in the direction from the connection port 62*c* toward the connection port 62*b* side (+D side) due to the transport by the first spiral blade 83. Therefore, a part of the developer G flows toward the junction port 62*a* via the surrounding of the second spiral blade 84 due to the inertia in the direction toward +D side. Therefore, the developer G transported from the third transport path 60*c* via the connection port 63 by the second paddle 94 and the developer G flowing from the connection port 62*b* side are merged around the junction port 62*a* in the second transport path 60*b*. As a result, the developer G transported from the third transport path 60*c* is likely to stay around the junction port 62*a*.

Meanwhile, the developing apparatus 50 of the exemplary embodiment has the first configuration, and thus, as compared with the developing apparatus of the first comparative embodiment, the inertia of the developer G around the second spiral blade 84 in the direction toward +D side is reduced, and thus, the developer G is less likely to flow toward the junction port 62*a*. Therefore, in the developing apparatus 50 having the first configuration, the developer G is prevented from being stayed around the junction port 62*a* as compared with the developing apparatus of the first comparative embodiment.

In the developing apparatus 50 having the first configuration, development spots due to the stay of the developer G is prevented as compared with the developing apparatus of the first comparative embodiment.

Then, in the image forming apparatus 10 including the developing apparatus 50 of the exemplary embodiment, image spots due to the stay of the developer G is prevented as compared with the image forming apparatus including the developing apparatus of the first comparative embodiment.

Further, the developing apparatus 50 of the exemplary embodiment has a configuration in which the second spiral blade 84 includes the reverse transport blade 84*a* (second configuration). Therefore, in the developing apparatus 50 having the second configuration, the developer G is prevented from being stayed in the junction port 62*a* as compared with a configuration in which the second spiral blade is constituted by only the forward transport blade 84*b* and the developer G is transported in the direction (+D side) from the connection port 62*b* to the junction port 62*a*.

Further, the developing apparatus 50 of the exemplary embodiment has a configuration in which the second spiral blade 84 includes the forward transport blade 84*b* (third configuration). The developing apparatus 50 having the third configuration will be compared with a developing apparatus as a second comparative embodiment described in the following.

In the developing apparatus of the second comparative embodiment, the second spiral blade of the second transport member 80 is constituted by only the reverse transport blade 84*a*. Except for the above aspects, the second comparative embodiment has the same configuration as the exemplary embodiment.

In the developing apparatus of the second comparative embodiment, a part of the developer G transported from the third transport path 60*c* toward the connection port 63 is drawn in the direction (−D side) from the connection port 63 side to the connection port 62*b* side by the second spiral blade constituted by only the reverse transport blade 84*a*. However, since the developer G on the circulation path is being transported around the connection port 62*b*, the developer G drawn by the second spiral blade is likely to stay around the second spiral blade in the second transport path 60*b*.

Meanwhile, the developing apparatus 50 of the exemplary embodiment has the third configuration, and thus, as compared with the developing apparatus of the second comparative embodiment, the developer G around the connection port 63 in the second transport path 60*b* is less likely to be drawn in the direction (−D side) from the connection port 63 side toward the connection port 62*b* side. Therefore, in the developing apparatus 50 having the third configuration, the developer G transported from the third transport path 60*c* toward the connection port 63 is prevented from being stayed in the second transport path 60*b* as compared with the developing apparatus of the second comparative embodiment. The above described second comparative embodiment is included in the technical idea of the exemplary embodiment of the disclosure as a modified example of the exemplary embodiment, as described later.

Further, the developing apparatus 50 of the exemplary embodiment has a configuration in which, in the apparatus depth direction, the length of the opening width of the junction port 62*a* is larger than the length of the opening width of the connection port 62*b* (fourth configuration). Therefore, in the developing apparatus 50 having the fourth configuration, the amount of the developer G transported to the first transport path 60*a* via the junction port 62*a* increases as compared with the developing apparatus of a third comparative embodiment having a configuration in which the length of the opening width of the junction port 62*a* is smaller than the length of the opening width of the connection port 62*b*. In particular, with regard to the developing apparatus 50 having the configuration in which the developer G of a toner cartridge (not illustrated) is supplied to the third transport path 60*c*, in the developing apparatus 50 having the fourth configuration, the amount of the developer G transported to the first transport path 60*a* increases as compared with the developing apparatus of the third comparative embodiment. The above described third comparative embodiment is included in the technical idea of the exemplary embodiment of the disclosure as a modified example of the exemplary embodiment.

Further, the developing apparatus 50 of the exemplary embodiment has a configuration in which, in the apparatus depth direction, the portion of the first shaft 82 where the first shaft 82 faces the junction port 62*a* has a smaller diameter than the portion on −D side with respect to the junction port 62*a* (fifth configuration). The developing apparatus 50 having the fifth configuration will be compared with a developing apparatus on a fourth comparative embodiment having a configuration in which the outer diameter of the first shaft 82 is constant in the apparatus depth direction.

In the developing apparatus of the fourth comparative embodiment, the portion of the first shaft 82 where the first shaft 82 faces the junction port 62*a* has an outer diameter equal to the portion of the first shaft 82 where the first spiral blade 83 is provided. Therefore, in the second transport path 60*b*, the amount of the developer G that may be accommodated around the portion of the first shaft 82 where the first shaft 82 faces the junction port 62*a* is greater in the developing apparatus 50 having the fifth configuration than the developing apparatus of the fourth comparative embodiment. Further, the length of the first paddle 85 of the first shaft 82 in the radial direction, that is, the size of the first paddle 85 is greater in the developing apparatus 50 having the fifth configuration than the developing apparatus of the fourth comparative embodiment. Therefore, in the developing apparatus 50 having the fifth configuration, the amount of the developer G transported from the second transport path 60*b* to the first transport path 60*a* via the junction port 62*a* increases as compared with the developing apparatus of the fourth comparative embodiment. The above described fourth comparative embodiment is included in the technical idea of the exemplary embodiment of the disclosure as a modified example of the exemplary embodiment.

Further, the developing apparatus 50 of the exemplary embodiment has a configuration in which, the portion of the first shaft 82 of the second transport member 80 where the first shaft 82 faces the connection port 62*b* is provided with only the first spiral blade 83 (sixth configuration). The developing apparatus 50 having the sixth configuration will be compared with a developing apparatus as a fifth comparative embodiment described in the following.

In the developing apparatus of the fifth comparative embodiment, a paddle that transports the developer G toward the first transport path 60*a* is formed in the portion of the first shaft 82 where the first shaft 82 faces the connection port 62*b*. Except for the above aspects, the fifth comparative embodiment has the same configuration as the exemplary embodiment.

The developing apparatus 50 of the exemplary embodiment has the first configuration to the third configuration, and thus, the developer G having a sufficient amount to be circulated through the circulation path flows into the first transport path 60*a* from the second transport path 60*b* via the connection port 62*b*. Meanwhile, the developing apparatus of the fifth comparative embodiment has the paddle that transports the developer G toward the first transport path 60*a* in addition to the first configuration to the third configuration, and thus, the amount of the developer G flowing into the first transport path 60*a* from the second transport path 60*b* via the connection port 62*b* is likely to be excessive. Therefore, in the developing apparatus having the sixth configuration, the developer G is prevented from excessively flowing into the first transport path 60*a* from the second transport path 60*b* via the connection port 62*b* as compared with the developing apparatus of the fifth comparative embodiment. The above described fifth comparative embodiment is included in the technical idea of the exemplary embodiment of the disclosure as a modified example of the exemplary embodiment.

Further, the developing apparatus 50 of the exemplary embodiment has a configuration in which the third transport member 90 is provided with the second paddle 94 that transports the developer G from the upper side of the second shaft 92 to the connection port 63 side as a consequence of the rotation of the second shaft 92 of the third transport member 90 (seventh configuration). Therefore, in the developing apparatus 50 having the seventh configuration, the developer G transported by the second paddle 94 is prevented from being compressed as compared with the developing apparatus of the sixth comparative embodiment having a configuration in which the second paddle scoops up the developer G from the lower side of the second shaft 92 to transport to the connection port 63 side. The above described sixth comparative embodiment is included in the technical idea of the exemplary embodiment of the disclosure as a modified example of the exemplary embodiment.

That is, the developing apparatus 50 of the exemplary embodiment has a configuration in which the bottom portion of the second transport path 60*b* is positioned above the bottom portion of the third transport path 60*c* in the gravity direction (eighth configuration). Therefore, in the developing apparatus 50 having the seventh configuration, the transport of the developer G from the third transport path 60*c* to the second transport path 60*b* is stabilized as compared with the developing apparatus of the sixth comparative embodiment of the developing apparatus having the eighth configuration.

As stated above, the specific exemplary embodiment of the disclosure is described in detail. However, the disclosure is not limited to the above exemplary embodiment, but various modifications, changes, and improvements may be made within the scope of the technical idea of the disclosure.

For example, in the exemplary embodiment, the second spiral blade 84 includes the reverse transport blade 84*a* and the forward transport blade 84*b*. However, the second spiral blade 84 may be constituted by only the reverse transport blade 84*a*, or may be constituted by only the forward transport blade 84*b*.

Further, in the exemplary embodiment, the reverse transport blade 84*a* and the forward transport blade 84*b* have a blade diameter equal to the blade diameter of the first spiral blade 83 and a pitch smaller than the pitch of the first spiral blade 83. In the second spiral blade 84, the reverse transport blade 84*a* and the forward transport blade 84*b* may have a blade diameter smaller than the blade diameter of the first spiral blade 83 and a pitch equal to the pitch of the first spiral blade 83.

Further, in the exemplary embodiment, the bottom portion of the second transport path 60*b* is positioned above the bottom portion of the third transport path 60*c* in the gravity direction. However, the bottom portion of the second transport path 60*b* may be positioned at the position equal to the bottom portion of the third transport path 60*c* in the gravity direction, or may be positioned below the bottom portion of the third transport path 60*c*.

Further, in the exemplary embodiment, the forward transport blades 73 and 93 and the first spiral blade 83 are double-banded spiral blade bodies. However, the number of bands of the forward transport blades 73 and 93 and the first spiral blade 83 may be one, or may be more than three. Further, in the exemplary embodiment, the reverse transport blades 74 and 94, the second spiral blade 84, and the third spiral blade 86 are single-banded spiral blade bodies. However, the number of bands of the reverse transport blades 74 and 94, the second spiral blade 84, and the third spiral blade 86 may be more than two.

Further, in the exemplary embodiment of the disclosure, the developing apparatus 50 having the circulation path constituted by the first transport path 60*a*, the connection port 62*c*, the second transport path 60*b*, and the connection port 62*b* is an example of the powder transport apparatus according to the exemplary embodiment of the disclosure. However, the powder transport apparatus according to the exemplary embodiment of the disclosure is not limited to the developing apparatus having the circulation path as long as the developing apparatus has equivalents of the junction port 62*a*, the connection port 62*b* (the first connection port), and the connection port 63 (the second connection port). For example, the powder transport apparatus according to the exemplary embodiment of the disclosure may be a waste toner transport apparatus that has a first sub-transport path connected to a main transport path at the first connection port and the junction port and a second sub-transport path connected to the main transport path at the second connection port and the junction port via the first sub-transport path, and that transports a waste toner.

Further, in the above example, the example in which the powder transport apparatus is applied to an electrophotographic developing apparatus is described. However, the disclosure is not limited thereto, and may be applied to purposes other than development.

For example, a powder coating apparatus may be configured by using the developer in each of the above exemplary embodiments as a coating powder. Specifically, the developing apparatus of each exemplary embodiment is used as a powder coating head in an electrostatic powder coating method, and is brought close to the powder coating head to transport a conductive sheet-shaped medium. A bias voltage is applied between the powder coating head and the conductive sheet-shaped medium, and thus charged coating powder (e.g., thermosetting toner) is applied on the sheet-shaped medium. Thereafter, the surface of the sheet-shaped medium is painted by heating the sheet-shaped medium.

Further, the disclosure may be applied to other manufacturing apparatuses using powder. For example, the disclosure may be applied to an apparatus that transports carbon black used for manufacturing in a manufacturing apparatus that manufactures an electrode body of a secondary battery.

Further, a purpose of powder such as powder for medicine or powder for food is not limited, and a form of the apparatus such as a manufacturing apparatus, a processing apparatus, or an inspection apparatus is not limited as long as the apparatus uses powder.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A powder transport apparatus comprising:

a first transport path extending in one direction, a first transport member being disposed in the first transport path;

a second transport path extending in the one direction, the second transport path being connected to the first transport path through a first connection port and a junction port positioned closer to an end side of the one direction than the first connection port;

a third transport path extending in the one direction, the third transport path being connected to the second transport path through a second connection port positioned to be overlapped with the junction port in the one direction;

a second transport member disposed in the second transport path, the second transport member comprising a first shaft that extends in the one direction, the first shaft being provided with a first spiral blade configured to transport powder toward the first connection port from a side opposite to the junction port side across the first connection port in the one direction;

a second spiral blade provided in a portion of the first shaft between the first connection port and the junction port, the second spiral blade having a transport force smaller than a transport force of the first spiral blade in the one direction; and a third transport member disposed in the third transport path, the third transport member being configured to transport the powder toward the second connection port.

2. The powder transport apparatus according to claim 1, wherein the second spiral blade comprises a reverse transport unit configured to transport the powder from the junction port side toward the first connection port side.

3. The powder transport apparatus according to claim 2, wherein the second spiral blade comprises a forward transport unit that is provided on a side opposite to the first spiral blade side with respect to the reverse transport unit in the one direction, the forward transport unit being configured to transport the powder from the first connection port side toward the junction port side.

4. The powder transport apparatus according to claim 1, wherein the first transport path and the second transport path form a circulation path in which the powder is circulated by driving the first transport member and the second transport member, the third transport path is configured to transport powder supplied to the third transport path from an outside by driving the third transport member, and an opening width of the junction port is larger than an opening width of the first connection port in the one direction.

5. The powder transport apparatus according to claim 1, wherein in the second transport member, a portion of the first shaft where the first shaft faces the junction port has a diameter smaller than that of a portion of the first shaft where the first spiral blade is provided, and the second transport member comprises a first paddle in the portion of the first shaft where the first shaft faces the junction port, the first paddle being configured to transport the powder to the first transport path side.

6. The powder transport apparatus according to claim 1, wherein the first transport path and the second transport path form a circulation path in which powder is circulated by driving the first transport member and the second transport member, the third transport path is configured to transport powder supplied to the third transport path from an outside by driving the third transport member, and the second transport member comprises a first paddle in a portion of the first shaft where the first shaft faces the junction port, the first paddle being configured to transport the powder to the first transport path side, and only the first spiral blade is provided in a portion of the first shaft where the first shaft faces the first connection port.

7. The powder transport apparatus according to claim 1, wherein the third transport member comprises a second paddle in a portion of a second shaft where the second shaft faces the second connection port, the second shaft extending in the one direction, the second paddle being configured to transport powder from an upper side of the second shaft to the second connection port side with rotation of the second shaft.

8. The powder transport apparatus according to claim 2, wherein the third transport member comprises a second paddle in a portion of a second shaft where the second shaft faces the second connection port, the second shaft extending in the one direction, the second paddle being configured to transport powder from an upper side of the second shaft to the second connection port side with rotation of the second shaft.

9. The powder transport apparatus according to claim 3, wherein the third transport member comprises a second paddle in a portion of a second shaft where the second shaft faces the second connection port, the second shaft extending in the one direction, the second paddle being configured to transport powder from an upper side of the second shaft to the second connection port side with rotation of the second shaft.

10. The powder transport apparatus according to claim 4, wherein the third transport member comprises a second paddle in a portion of a second shaft where the second shaft faces the second connection port, the second shaft extending in the one direction, the second paddle being configured to transport powder from an upper side of the second shaft to the second connection port side with rotation of the second shaft.

11. The powder transport apparatus according to claim 5, wherein the third transport member comprises a second paddle in a portion of a second shaft where the second shaft faces the second connection port, the second shaft extending in the one direction, the second paddle being configured to transport powder from an upper side of the second shaft to the second connection port side with rotation of the second shaft.

12. The powder transport apparatus according to claim 6, wherein the third transport member comprises a second paddle in a portion of a second shaft where the second shaft faces the second connection port, the second shaft extending in the one direction, the second paddle being configured to transport powder from an upper side of the second shaft to the second connection port side with rotation of the second shaft.

13. The powder transport apparatus according to claim 7, wherein a bottom portion of the second transport path is positioned above a bottom portion of the third transport path in a gravity direction.

14. The powder transport apparatus according to claim 8, wherein a bottom portion of the second transport path is positioned above a bottom portion of the third transport path in a gravity direction.

15. The powder transport apparatus according to claim 9, wherein a bottom portion of the second transport path is positioned above a bottom portion of the third transport path in a gravity direction.

16. The powder transport apparatus according to claim 10, wherein a bottom portion of the second transport path is positioned above a bottom portion of the third transport path in a gravity direction.

17. The powder transport apparatus according to claim 11, wherein a bottom portion of the second transport path is positioned above a bottom portion of the third transport path in a gravity direction.

18. The powder transport apparatus according to claim 12, wherein a bottom portion of the second transport path is positioned above a bottom portion of the third transport path in a gravity direction.

19. A powder transport apparatus comprising:

a first transport path extending in one direction, first transport means being disposed in the first transport path;

a second transport path extending in the one direction, the second transport path being connected to the first transport path through a first connection port and a junction port positioned closer to an end side of the one direction than the first connection port;

a third transport path extending in the one direction, the third transport path being connected to the second transport path through a second connection port positioned to be overlapped with the junction port in the one direction;

second transport means disposed in the second transport path, the second transport means comprising a first shaft that extends in the one direction, the first shaft being provided with first spiral blade means for transporting powder toward the first connection port from a side opposite to the junction port side across the first connection port in the one direction;

second spiral blade means provided in a portion of the first shaft between the first connection port and the junction port, the second spiral blade means having a transport force smaller than a transport force of the first spiral blade means in the one direction; and third transport means disposed in the third transport path, the third transport means for transporting the powder toward the second connection port.

* * * * *